US009982481B2

(12) United States Patent
Marocco

(10) Patent No.: US 9,982,481 B2
(45) Date of Patent: May 29, 2018

(54) ARCH WINDOW COVERING WITH CONTROL

(71) Applicant: Mario M Marocco, Toronto (CA)

(72) Inventor: Mario M Marocco, Toronto (CA)

( * ) Notice: Subject to any disclaimer, the term of this patent is extended or adjusted under 35 U.S.C. 154(b) by 0 days. days.

(21) Appl. No.: 14/757,146

(22) Filed: Nov. 25, 2015

(65) Prior Publication Data

US 2017/0145738 A1 May 25, 2017

(51) Int. Cl.

| | |
|---|---|
| ***E06B 9/24*** | (2006.01) |
| ***E06B 9/264*** | (2006.01) |
| ***E06B 9/386*** | (2006.01) |
| ***E06B 9/262*** | (2006.01) |

(52) U.S. Cl.

CPC ..... *E06B 9/264* (2013.01); *E06B 9/262* (2013.01); *E06B 9/386* (2013.01); *E06B 2009/2405* (2013.01); *E06B 2009/2435* (2013.01); *E06B 2009/2447* (2013.01); *E06B 2009/2482* (2013.01); *E06B 2009/2488* (2013.01); *E06B 2009/2627* (2013.01)

(58) Field of Classification Search

CPC ..... E06B 2009/2405; E06B 2009/2435; E06B 2009/2488; E06B 2009/2627; E06B 9/264; E06B 9/386

USPC ..... 160/179, 113, 107

See application file for complete search history.

(56) References Cited

U.S. PATENT DOCUMENTS 2,234,804 A * 3/1941 Murray ..... B60J 1/2088 160/169
2,617,329 A * 11/1952 Dreyer ..... G02B 27/281 160/166.1
3,318,360 A * 5/1967 Persson ..... E06B 9/264 160/107
3,646,986 A * 3/1972 Anderle ..... E06B 9/303 160/168.1 R
4,518,025 A * 5/1985 Judkins ..... E06B 9/323 160/168.1 R
4,556,095 A * 12/1985 Lewis ..... E06B 9/264 160/166.1
4,611,648 A * 9/1986 Anderson ..... E06B 9/264 160/107
4,664,169 A * 5/1987 Osaka ..... E06B 9/264 160/107
4,723,586 A * 2/1988 Spangenberg ..... E06B 9/264 160/107

(Continued)

FOREIGN PATENT DOCUMENTS

KR 1020140064783 * 5/2015 ..... E06B 9/322

OTHER PUBLICATIONS

An, Eun Ro, English Translation of "KR 10-2014-0064783" May 27, 2015. Accessed from <http://eng.kipris.or.kr/enghome/main.jsp>.*

*Primary Examiner* — Katherine W Mitchell
*Assistant Examiner* — Johnnie A. Shablack

(57) ABSTRACT

A non rectangular controllable window covering, for a window frame of corresponding non rectangular shape and having a covering frame defining a base frame segment and a non rectangular frame segment together forming a covering frame to fit the non rectangular window frame, and a window covering supported in the covering frame, consisting of a first covering panel and a second covering panel spaced apart from one another, one of the covering panels being movable relative to the other, and, a control element connected to the moveable covering panel.

16 Claims, 5 Drawing Sheets

(56) References Cited

U.S. PATENT DOCUMENTS 4,768,576 A * 9/1988 Anderson ..... E06B 9/264 160/107
4,901,419 A * 2/1990 Voss ..... E06B 9/262 160/84.04
4,934,436 A * 6/1990 Schnebly ..... E06B 9/24 160/134
5,092,383 A * 3/1992 Niemeijer ..... E06B 9/262 160/134
5,164,856 A * 11/1992 Zhang ..... E06B 9/24 359/486.02
5,320,154 A * 6/1994 Colson ..... E06B 9/171 160/121.1
5,419,385 A * 5/1995 Vogel ..... E06B 9/262 160/121.1
5,632,316 A * 5/1997 Cohen ..... E06B 9/303 160/168.1 R
5,664,613 A * 9/1997 Jelic ..... E06B 9/30 160/121.1
5,823,241 A * 10/1998 Sitzes ..... E06B 9/28 16/249
5,855,235 A * 1/1999 Colson ..... E06B 9/171 160/121.1
5,860,464 A * 1/1999 Schon ..... E06B 9/262 160/84.06
6,062,291 A * 5/2000 Morgan ..... E06B 9/28 160/172 R
6,164,363 A * 12/2000 Colson ..... E06B 9/262 160/166.1
6,328,090 B1 * 12/2001 Anderson ..... E06B 9/264 160/107
6,390,172 B1 * 5/2002 Fleishman ..... E06B 9/26 160/168.1 V
6,478,071 B1 * 11/2002 Workman ..... E06B 9/32 160/169
6,651,722 B1 * 11/2003 Fleishman ..... E06B 9/26 160/168.1 V
6,772,815 B1 * 8/2004 Judkins ..... E06B 9/264 160/178.3
6,923,237 B2 * 8/2005 Workman ..... E06B 9/32 160/169
7,059,378 B2 * 6/2006 Colson ..... B29C 65/02 160/121.1
7,082,719 B2 * 8/2006 Regnery ..... E06B 7/086 49/403
7,240,714 B2 * 7/2007 Drew ..... E06B 9/26 160/84.04
7,261,137 B2 * 8/2007 Dekker ..... E06B 9/262 160/115
7,302,985 B2 * 12/2007 Larsen ..... E06B 9/262 160/169
7,383,870 B2 * 6/2008 Larsen ..... E06B 9/262 160/169
7,513,294 B2 * 4/2009 Jelic ..... E06B 9/262 160/349.1
7,628,195 B2 * 12/2009 Drew ..... E06B 7/086 160/176.1 R
7,694,696 B2 * 4/2010 Chang ..... D03D 1/08 139/383 R
8,082,693 B2 * 12/2011 Marocco ..... E06B 7/086 49/403
8,205,384 B2 * 6/2012 Fraser ..... E06B 9/28 49/505
8,261,807 B2 * 9/2012 Dann ..... E06B 9/24 160/121.1
8,459,325 B2 * 6/2013 Faller ..... E06B 9/262 160/134
8,496,039 B1 * 7/2013 Barresi ..... E06B 7/09 160/107
8,534,342 B2 * 9/2013 Grossman ..... E06B 9/262 160/126
8,807,192 B2 8/2014 Marocco
8,959,835 B2 * 2/2015 Drohan ..... E06B 3/6722 49/63
9,282,845 B2 * 3/2016 Byun ..... E06B 9/42
9,328,556 B2 * 5/2016 Blair ..... E06B 9/44
9,353,570 B2 * 5/2016 Smith ..... E06B 9/38
9,512,672 B2 * 12/2016 Colson ..... E06B 9/42
2002/0053409 A1 * 5/2002 Anderson ..... E06B 7/30 160/84.05
2003/0070767 A1 * 4/2003 Workman ..... E06B 9/32 160/84.04
2006/0027339 A1 * 2/2006 Hsu ..... E06B 9/40 160/120
2006/0101717 A1 * 5/2006 Marocco ..... E06B 9/266 49/74.1
2006/0180278 A1 * 8/2006 Colson ..... B29C 65/02 160/84.04
2007/0175596 A1 * 8/2007 Chien ..... E06B 9/34 160/121.1
2008/0034661 A1 * 2/2008 Halter ..... E06B 9/264 49/39
2008/0314529 A1 * 12/2008 Coole ..... E06B 9/30 160/168.1 R
2009/0139173 A1 * 6/2009 Wilkins ..... E06B 7/08 52/473
2010/0200175 A1 * 8/2010 Lin ..... E06B 9/262 160/113
2012/0043029 A1 * 2/2012 Gaskill ..... E06B 9/42 160/121.1
2012/0085504 A1 * 4/2012 Cha ..... D03D 1/08 160/236
2014/0027071 A1 * 1/2014 Wilson, Sr. ..... E06B 9/38 160/173 R
2014/0261851 A1 * 9/2014 Cha ..... D03D 11/02 139/384 A
2014/0262069 A1 * 9/2014 Drew ..... E06B 9/44 160/120
2015/0121760 A1 * 5/2015 Drohan ..... E06B 7/30 49/86.1
2016/0258211 A1 * 9/2016 Smith ..... E06B 9/38
2017/0037679 A1 * 2/2017 An ..... E06B 9/34

* cited by examiner

ARCH WINDOW COVERING WITH CONTROL

FIELD OF THE INVENTION

The invention relates to an ARCH WINDOW COVERING WITH CONTROL, for adjusting the light and dark effects of a non-rectangular window covering panel.

BACKGROUND OF THE INVENTION

Window coverings such as shutters and blinds for windows of rectangular shape using various different blind materials, including fabrics of various kinds, enable the user to control the light or dark effect of the covering. In this way the user can adjust the covering to provide light, or dark, effects at various times, at will.

Most of such coverings have controls by which the entire covering panel, ie a rectangle of covering, can be provided with controls for either raising or lowering the covering, or for moving the covering material in such a way that the light or dark effects of the covering are varied, throughout the entire panel of covering material.

Many such window covering controls are motorised, permitting the owner to control the covering effect from a distance.

However, window coverings are also required to cover non-rectangular windows. These may be an arch shape, like a fan light, or an angular shape, with a non rectangular side, depending on the building design. In these cases the problem of providing a window covering with adjustable light and dark effects becomes more of a challenge.

It is also desirable that such window coverings may follow current tastes in decorating.

Various different types of fabrics are available, in which the light and dark shading can be varied simply by moving the material itself, without manipulating mechanical parts of the coverings themselves.

One such material embodies a series of alternate light permeable, and dark strips.

Using this type of material and by hanging two panels of the material spaced slightly separate from one another, it is possible to either align light strips in one panel with the light strips in the other panel, to allow more light to pass, or to align light and dark strips in respective panels, thereby reducing the light passing through.

Another type of material, such as that shown in U.S. Pat. No. 5,664,613 Jelic dated September 1997, employs two spaced apart panels of light permeable material, and a series of dark strips extending between and secured between the two panels.

By moving one panel relative to the other, the dark strips can be rendered more or less horizontal, allowing light to pass, or by moving one panel, the dark strips can be moved to a more or less upright orientation, causing a reduced light passage.

These materials enable a home owner to select material which may most suit the decor, while enabling the manufacturer to offer the widest variety of panel colours and effects.

It will be appreciated that there are various different asymmetrical or non rectangular window shapes. In many cases these will be a smooth arc, in the form of what is known as a Saxon arch, in the form of a fan light over a door or an existing window.

Other windows may have a pointed arch, or what is known as a Norman arch.

In other cases the windows may have linear but non rectangular shapes.

For the sake of simplicity in this specification all such non rectangular shapes will be referred to as an "ARCH".

BRIEF SUMMARY OF THE INVENTION

The invention provides an arch shaped window covering, for a window of corresponding shape having a window covering frame defining a base frame segment, and at least one non rectangular arch frame segment, together forming a window covering frame to fit the window, and a window covering panel supported in said frame, said window covering panel having a first panel portion and a second panel portion spaced apart from one another, and at least one said panel portion being movable relative to the other, and a control element connected to said at least one moveable panel portion.

Preferably, the invention provides such a window covering, provided with a hollow arch frame portion, and wherein said control element is contained within said hollow arch frame portion. The arch frame portion will define a highest point or apex, and the control element will extend down from the frame at that apex, and will connect with the window covering material. The other end of the control element will exit from one end of the arch frame portion, to enable operation thereof.

Preferably, the invention provides such a window covering wherein the moveable panel portion is provided with a top segment, formed of semi rigid material, and wherein the control element is connected to such segment.

Preferably, the invention provides such a window covering wherein the moveable window covering panel portion defines an area less than the area the other window covering panel portion.

In one embodiment, the control element may be operated by a remote controlled motor, for greater convenience.

Preferably, the control element comprises a flexible cord or chain like device which can run within the hollow arch frame, and which can be attached to the moveable panel portion, and which can depend downwardly free of one end of the hollow arch frame portion, for facilitating manual control.

Alternatively, the control element can be motorized, and the motor would be controlled by a remote control, similar to that in use in other window covering assemblies.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
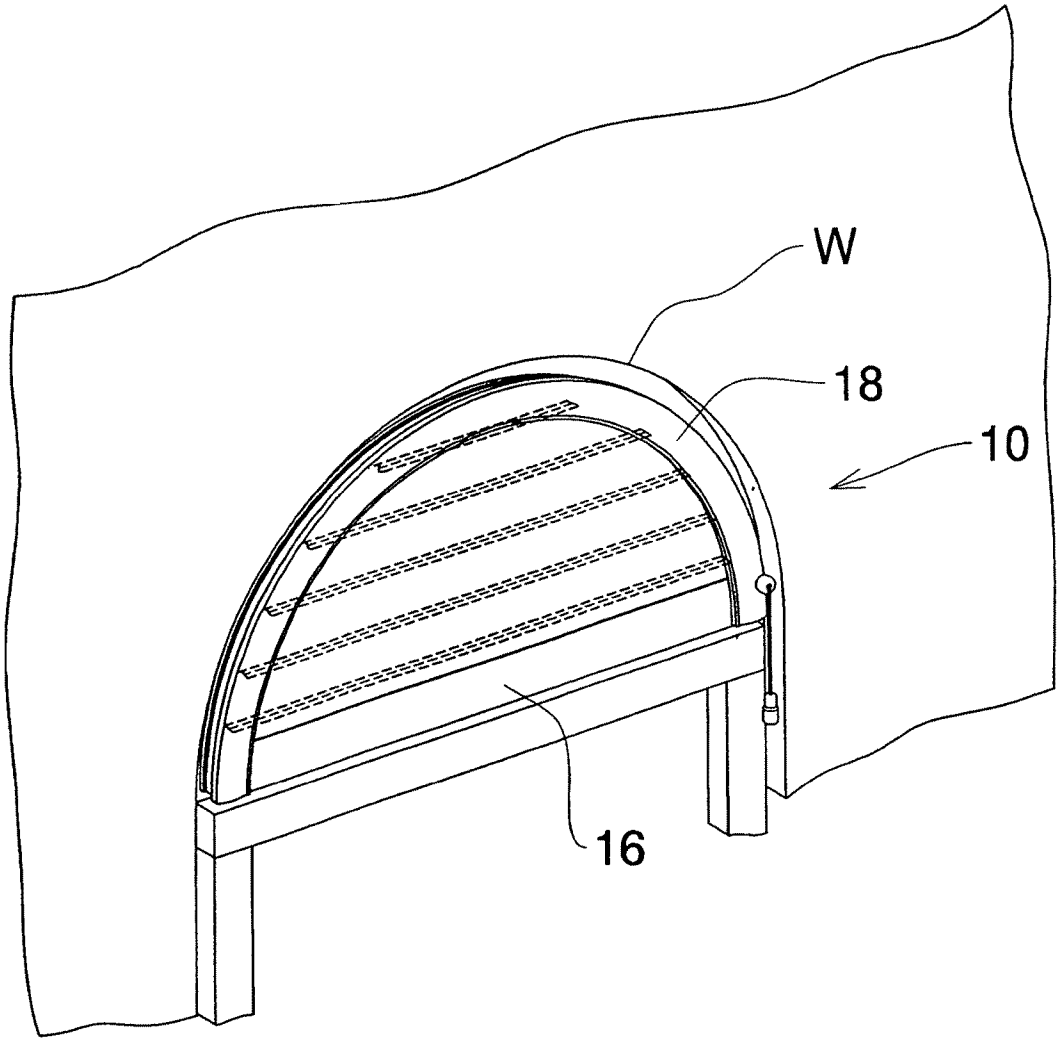
FIG. 1 is a perspective of a non rectangular window covering suitable for a non rectangular window of corresponding shape.

Referring first of all to FIG. 1, it will be seen that the invention is there illustrated in the form of a window covering (10), erected in position on a non-rectangular window (W)

It will be appreciated that the illustration of the invention as showing a generally semi circular arcuate arch is purely by way of example. As mentioned above the invention is equally applicable to windows of various other arch shapes including non-rectangular or asymmetrical shapes. For the purposes of this specification all such non-rectangular or asymmetric windows and window coverings are referred to as arch shaped.

The window covering (10) in this example will be seen to comprise a linear base frame portion (12) and an arcuate arch frame portion (14). The arch frame portion (14) at its two ends is connected to the base frame portion (12).

The two frame portions in this example are formed of extruded, thermoplastic, typically some kind of P.V.C. In order to provide an aesthetic appearance, front face cover mouldings (16) and (18) are provided. In this case the two front face mouldings are formed of wood, but could equally well be formed of some form of thermoplastic material if desired.

Typically the face mouldings will be adhesively bonded to the respective frame portions, but other forms of attachment and indeed other forms of material will suggest themselves to persons skilled in the art.

Figure 2:
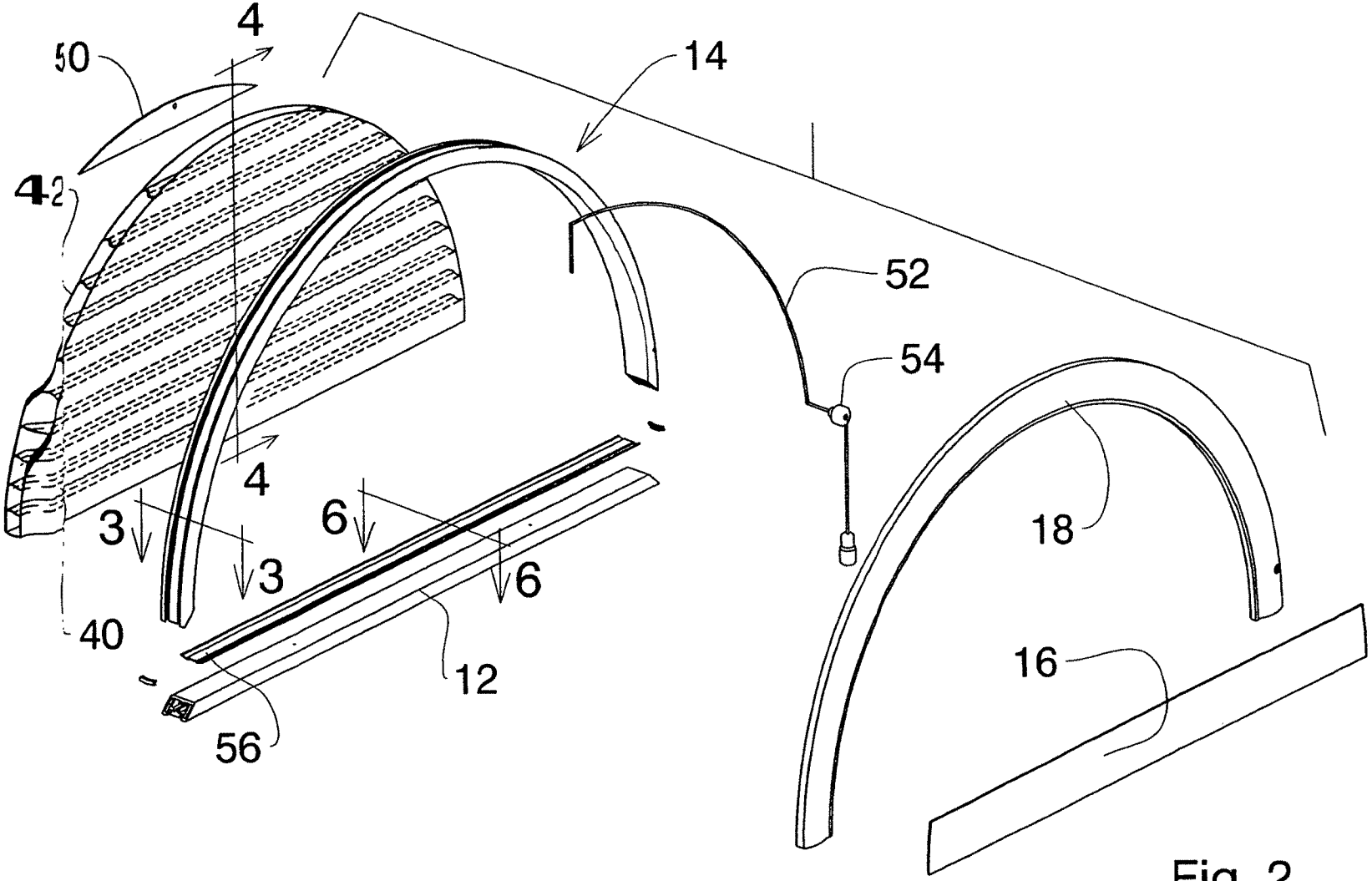
FIG. 2 is an exploded view of the window covering frame and covering material; of FIG. 1
Figure 3:
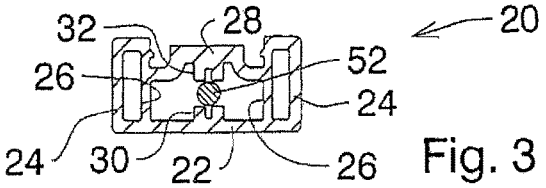
FIG. 3 is a section along line 3-3 of FIG. 2.

Referring now to FIGS. 2 and 3, it will be seen that both the arch frame portion (14) and the base frame portion (12) are formed of a tubular extrusion, shown generally as (20) (FIG. 3), defining an inwardly directed planar wall (22), and opposite side walls (24) and (24) normal thereto.

Inner walls (26) and (26) parallel to side walls (24), form rectangular hollow spaces along either side of the extrusion for greater strength. A transverse intermediate wall (28) extends between the two inner walls (26). The transverse wall (28), and the inner walls (24) and (24), and the planar wall (22), together define a generally rectangular shaped tube extending through the extrusion (20).

Internal channel guide ribs (30), and (32) are formed in pairs respectively on the inside of the planar wall (22) and the inner side of the intermediate transverse wall (28), in opposition to one another.

The tubular extrusion (20) is formed into a non-rectangular shape, in this case an arcuate shape, according to well understood bending technology. The planar wall (22) will be directed on the inside of the curve, and the side walls (24) and (24) will face front and back, normal to the planar wall.

The window blind covering (39) includes, in this case, two panels of a flexible material, typically a fabric of some kind, namely an inner covering panel (40) and an outer covering panel (42), the terms inner and outer, in this case, simply referring to the building itself.

The panels are preferably of translucent material, capable of passing exterior light, to some extent, into the building.

The window blind covering (39) also has generally S-shaped strips (44) of dark effect, light obstructing material extending between the two covering panels. The strips may be formed as extrusions of thermoplastic material, or some kind of dark effect synthetic material, although the invention is not restricted to such a material or form of manufacture.

Edges of the strips (44) are secured, at (46), to respective inner and outer covering panels (40) and (42). Such securement is flexible and permits the strips (44) to rotate up to ninety degrees, between a generally horizontal position (FIG. 4) and an almost vertical position (FIG. 5). In the horizontal position the two covering panels are spaced apart, (FIG. 4), and in the vertical position the two covering panels are drawn together, (FIG. 5). The spacing between the strips (44) (FIG. 4) is such that it is substantially equal to the width of the strips (44). When rotated vertical (FIG. 5) the edges of the strips will thus be adjacent to one another, and substantially obstruct light, creating a dark effect.

Figure 4:
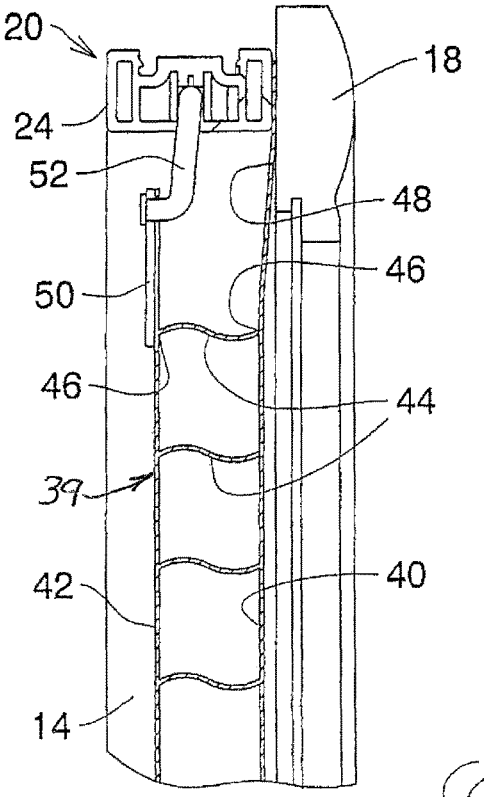
FIG. 4 is a section along line 4-4 of FIG. 2, with the moveable panel in a first position.
Figure 5:
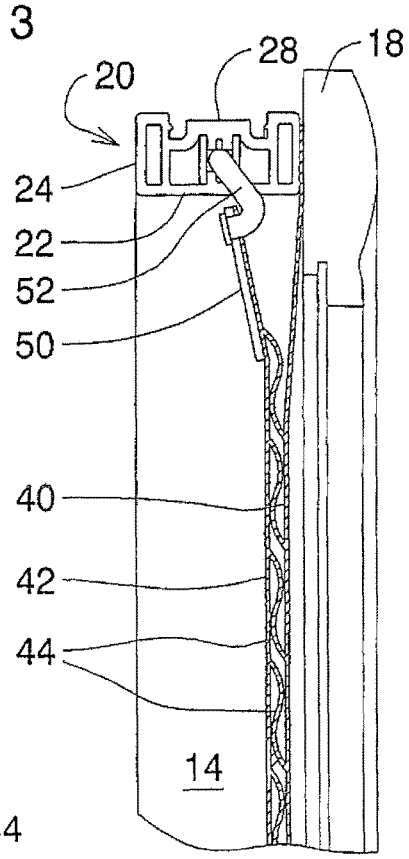
FIG. 5 is a section corresponding to FIG. 4 but with the movable panel in a second position.

It is seen that inner covering panel (40) is suspended by a central portion of its upper edge, which is pinched at (48) between frame (14) and face moulding (18), see FIG. 4. The inner panel thus simply hangs down, being cut to fit the shape of the frame (14).

The outer panel (42) is moveable. It is cut somewhat smaller than inner panel (40) so that it defines a free space between itself and the frame (14). Outer panel (42) has a more or less rigid or semi-rigid arcuate header (50) which is attached to the upper extremity of panel (42) Header (50) extends across and is fastened to a central portion of panel (42), and functions to provide a suspension for panel (42) and to hold the fabric of panel (42) spread evenly across the interior of frame (14).

In order to raise and lower panel (42), a single control element (52) is provided. Element (52) is threaded through the interior of frame (14) between guide channel ribs (30 and 32). Element (52) depends downwardly from any suitable opening (not shown) at the apex of frame (14), and is secured to header (50) Element (52) extends around the interior of frame (14) and exits, on one side, or the other, of frame (14) through any suitable opening.

Element (52) passes through a grommet (54) located in a suitable opening of face moulding (18), where it is accessible for hand operation. Any suitable cleat (not shown) such as is well known, can be secured to a side of the window frame, at a height where it is easily reached by a resident in the building.

In this way the window covering can be adjusted between light and dark effects by simple manipulation of the element (52).

In order to keep the two covering panels (40) and (42) hanging smoothly, a bottom rail (56) is provided. Rail (56) is attached to both of the two covering panels.

Figure 6:
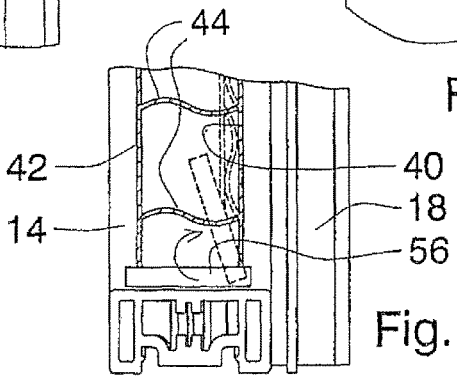
FIG. 6 is a section along 6-6 of FIG. 2 showing the bottom of the window covering.

When the outer panel is raised (FIG. 5) the rail (56) will simply rotate about 90 degrees shown in phantom in FIG. 6.

When outer covering panel (42) is released, the rail will rotate back to a more or less horizontal position, thus maintaining both panels hanging smoothly.

The invention is not restricted solely to the form of panels and strips as described above.

Figure 7:
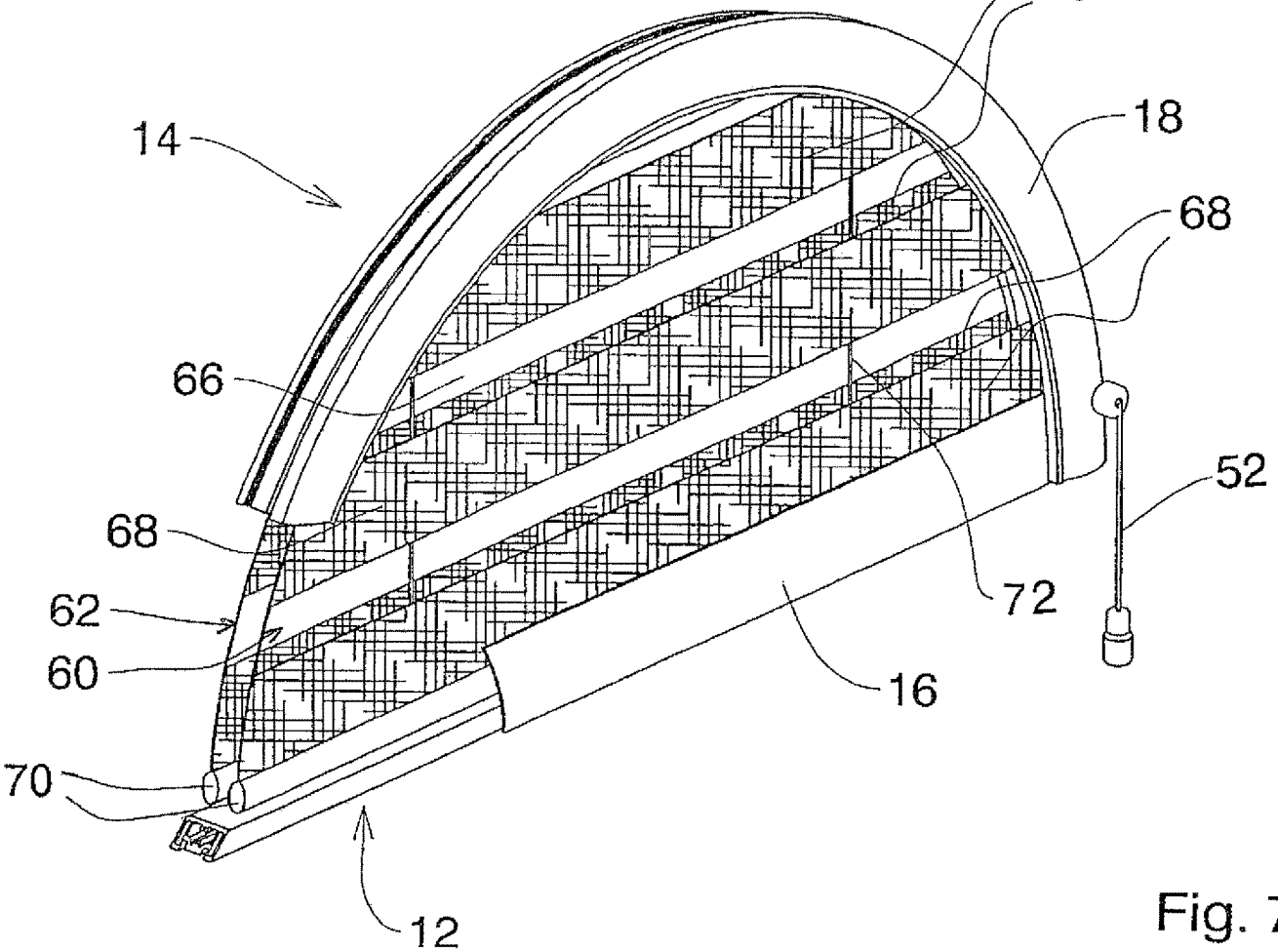
FIG. 7 is a perspective of a further embodiment showing a different form of panels.
Figure 8:
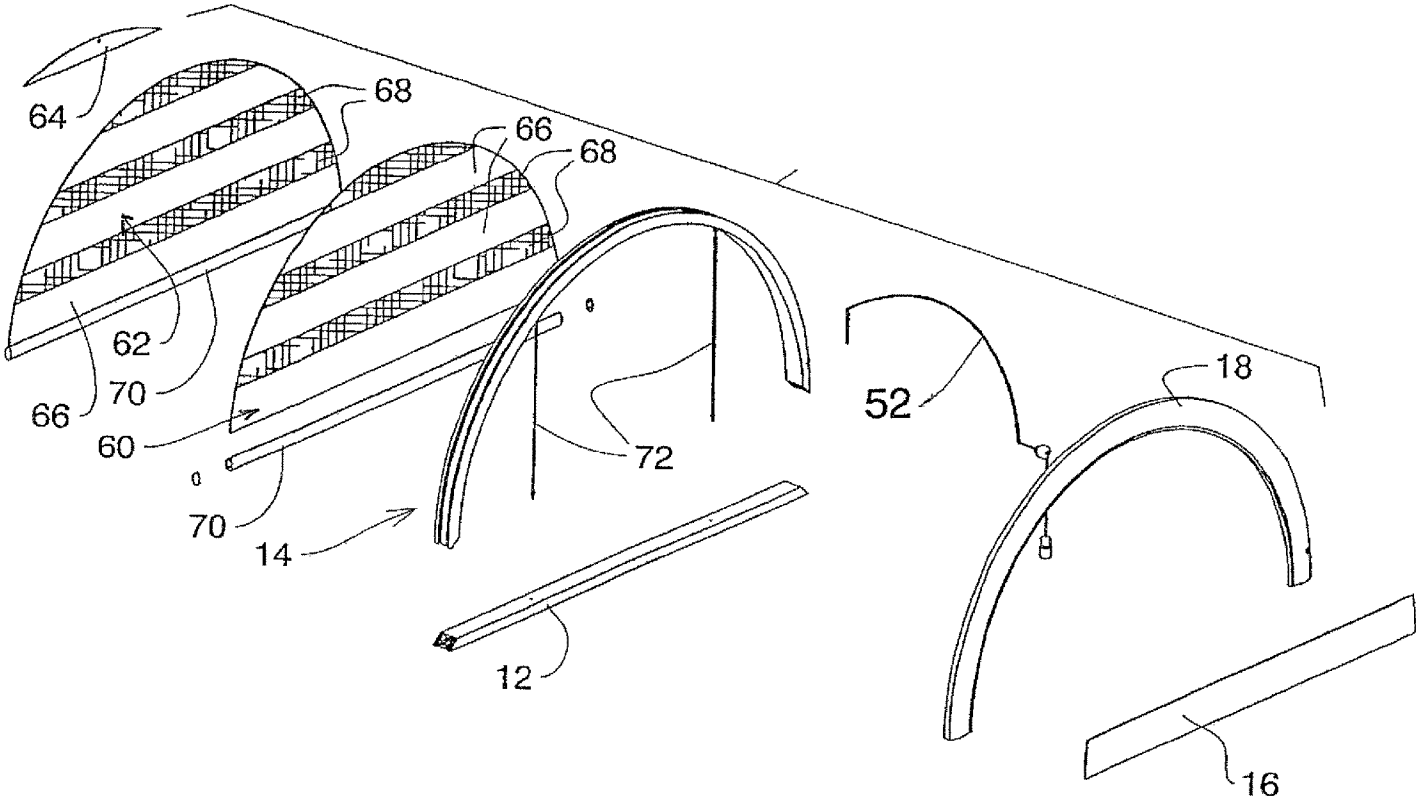
FIG. 8 is an exploded perspective of FIG. 7.

Another embodiment is shown in FIGS. 7 and 8. In this case an inner covering panel (60) is secured, as before, by being pinched between the frame and the face moulding, across a central portion of the top of panel (60).

An outer covering panel (62) has a more or less semi-rigid header (64) attached to a central portion of the top of the panel.

An element (52) is secured centrally to header (64). Element (52) passes through the interior of frame (14) as before, and exits through face moulding (18) and grommet.

Covering panel (62) is cut somewhat smaller than the shape of frame (14), so as to allow for up and down movement, relative to panel (60).

Both covering panels are formed of a fabric of some kind, typically a synthetic woven fabric. Each panel is formed with semi-translucent bars (66), and dark effect bars (68), alternately.

By adjusting the outer panel (62) the translucent bars in the two panels can be aligned with each other. This will allow some light to pass into the building.

When darker effects are required, the panel (62) can be adjusted so that the dark bars on panel (62) line up against the light bars on panel (60). This will have the effect of restricting passage of light, creating a darker effect inside the building.

In order to assist in keeping the two panels hanging straight down, each panel has its own bottom rail (70). Wires (72) extending from top to bottom of frame (14), further assist in controlling the panels (60) and (62).

While the invention is described with elements suitable for manual operation, it will be appreciated that motorised operation of the elements is also possible. The attachment of a motor to the frame, and connection to the element, in either case, is regarded as being within the competence of persons skilled in the art, and requires no separate illustration, or description.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A non-rectangular window covering, for mounting to a window frame of corresponding non-rectangular shape and comprising:

a base frame segment;

a non-rectangular frame segment, the base and non-rectangular frame segment together forming a non-rectangular covering frame to fit the window frame of corresponding non-rectangular shape, the base frame segment and non-rectangular frame segment having an enclosed hollow interior;

a window covering blind member supported in said non-rectangular covering frame, the window covering blind member including a fixed panel portion secured to said non-rectangular frame segment and a movable panel portion spaced apart from said fixed panel portion and adjustably supported relative to said non-rectangular frame segment, the window covering blind member being formed of both light permeable materials and light obstructing materials; and a control element extending along a portion and within the enclosed hollow interior of said non-rectangular frame segment and having an inner end that extends through an opening in said non-rectangular frame segment and is connected to said moveable panel portion and is operable to move said movable panel portion relative to said fixed panel portion, thereby moving said light permeable materials relative to the light obstruction materials to alter an amount of light passing through the window covering blind member.

2. The non-rectangular window covering as claimed in claim 1 wherein said non-rectangular frame segment is of arcuate shape.

3. The non-rectangular window covering as claimed in claim 1 wherein said non rectangular frame segment is of arcuate shape.

4. The non-rectangular window covering as claimed in claim 1, wherein said light permeable materials and said light obstructing materials are each respectively formed as a plurality of strips, said strips of light permeable materials alternating with said strips of light obstructing materials on each of said fixed panel portion and said movable panel portion.

5. The non-rectangular window covering as claimed in claim 4 including a first bottom rail secured to a bottom portion of said fixed panel portion and a second bottom rail secured to a bottom portion of said movable panel portion.

6. The non-rectangular window covering as claimed in claim 1, further including a pair of inner walls within the enclosed hollow interior of the base frame segment and non-rectangular frame segment, wherein the pair of inner walls are vertically oriented and spaced to create a central tube and a lateral tube on either side of the central tube within the base frame segment and the non-rectangular frame segment.

7. The non-rectangular window covering as claimed in claim 6, further including a set of internal channel guide ribs positioned within the central tube of the base frame segment and the non-rectangular frame segment.

8. The non-rectangular window covering as claimed in claim 1, wherein said fixed panel portion and said movable panel portion of said window covering blind member are each formed of said light permeable materials and said light obstructing materials are formed as a plurality of strips of light obstructing material, each strip connected to both said fixed panel portion and said movable panel portion.

9. The non-rectangular window covering as claimed in claim 8 including a bottom rail extending between and supported by both of said fixed and movable panel portions.

10. The non-rectangular window covering as claimed in claim 8 wherein said light obstructing strips are strips of light obstructing material defining oppositely oriented edges, and one said edge of each said strip being attached to said fixed panel portion and the other said edge of each said strip being attached to said movable panel portion.

11. The non-rectangular window covering as claimed in claim 10 wherein said light obstructing strips are generally S-shape in cross section.

12. The non-rectangular window covering as claimed in claim 1 including a header having an upper edge shaped to conform to the non-rectangular shape of said non-rectangular frame segment and secured on said movable panel portion so that said movable panel portion depends from the header, and said control element being attached to said header.

13. The non-rectangular window covering as claimed in claim 12 including an opening in said non-rectangular frame segment from which said control element depends downwardly for manual operation.

14. The non-rectangular window covering as claimed in claim 13 including a front face member attached to said non-rectangular frame segment, said control element having a portion passing through an opening in said front face member.

15. The non-rectangular window covering as claimed in claim 14 wherein said non-rectangular frame segment is of arcuate shape.

16. The non-rectangular window covering as claimed in claim 15 including another front face member attached to said base frame segment.

* * * * *